United States Patent [19]

MacNamara et al.

[11] 4,093,566

[45] June 6, 1978

[54] PHOSPHATE-FREE SPRAY CLEANER FOR METALS

[75] Inventors: Elizabeth L. MacNamara, Holland; Fred Pearlstein, Philadelphia, both of Pa.

[73] Assignee: The United States of America as represented by the Secretary of the Army, Washington, D.C.

[21] Appl. No.: 750,784

[22] Filed: Dec. 27, 1976

[51] Int. Cl.[2] ..... C11D 3/08; C11D 3/10; C11D 3/33

[52] U.S. Cl. ..... 252/527; 252/89 R; 252/135; 252/156; 252/173; 252/DIG. 1; 252/DIG. 14

[58] Field of Search ..... 252/135, 156, 173, 527, 252/DIG. 14, 89, DIG. 1

[56] References Cited

U.S. PATENT DOCUMENTS

| | | | |
|---|---|---|---|
| 2,099,743 | 11/1937 | Kroeger | 210/23 |
| 3,852,209 | 12/1974 | Hofmann | 252/95 |
| 3,910,855 | 10/1975 | Abeles | 252/527 |

*Primary Examiner*—Dennis L. Albrecht

*Attorney, Agent, or Firm*—Nathan Edelberg; Harold H. Card, Jr.; A. Victor Erkkila

[57] ABSTRACT

Spray cleaner formulations useful in the surface treatment of metallic ammunition components and the like and comprising sodium metasilicate, sodium carbonate, and either sodium hydroxide or ethylenediamine tetraacetic acid, the cleaner formulation being completely devoid of phosphates such that the spent cleaning formulation, when discharged into waterways, will not promote algae growth therein or eutrophication thereof.

6 Claims, No Drawings

PHOSPHATE-FREE SPRAY CLEANER FOR METALS

The invention described herein may be manufactured, used and licensed by or for the Government for governmental purposes without the payment to us of any royalty thereon.

This invention relates to ecology and more particularly concerns improved spray cleaner formulations which will not promote algae growth when discharged into waterways.

A significant source of pollution of waterways is the discharge thereinto of chemicals which are used in cleaning (degreasing) ammunition parts during and subsequent to their manufacture and various coating compositions which serve as paint bases or corrosion inhibitors. Particularly detrimental are the discharge effluents from alkaline cleaners, various phosphate solutions and chromic acic rinse solutions. Since the discharge of these "pollutants" is usually by batch dumping wherein concentrations thereof are relatively high, cyclic pollution effects are often serious.

Over the years, little change has occurred in cleaner formulations. Phosphates and detergents have been incorporated therein to provide more effective rinsing and the sequestering of metal ions. Additionally, phosphates act as buffers and synergists to the surfactants. Effluents containing phosphates, however, promote algae growth, which if permitted to continue unimpeded, will eutrophy our waterways. Little effort has been expended in the past to control these phosphate effluents, except in the reduction of their concentration to within allowable limits. Even so, disposal constraints are met, if at all, only with difficulty, or the resultant low phosphate cleaners are not effective for their designed objectives.

Accordingly, it is a broad object of this invention to provide a phosphate-free spray cleaner for metals, and more particularly to the surface treatment of metallic ammunition components.

Another object of the invention is to provide such a cleaner as aforementioned which will not significantly promote algae growth in, or eutrophication of waterways when disposed thereinto.

These and further objects of the invention will become apparent from the descrption which follows.

Briefly, we have discovered a very satisfactory phosphate-free spray cleaner comprising sodium metasilicate and sodium carbonate with either sodium hydroxide or a water softening or sequestering agent such as EDTA (ethylenediamine tetraacetic acid).

More specifically, 10 g/l (balance tap water) of phosphate-free spray cleaner comprising, by weight, 50% Na metasilicate, with either 40% Na carbonate and 10% EDTA or 20% Na carbonate and 30% Na hydroxide, both cleaning formulations having about ½ gram wetting agent added thereto, have been formulated which perform very satisfactorily on surface treatment lines and yet offer substantially less "pollution" than currently used cleaners when discharged into waterways.

In further clarification of our invention, a small spraying chamber measuring approximately 60 cm × 60 cm × 60 cm was fabricated in order to simulate spray cleaning operations in a continuous system. Cleaning formulations were prepared to contain 10 grams of cleaner per liter of tap water with 0.5 g added of any suitable wetting agent such as a commercially available polyethoxylated straight chain alcohol, or any other suitable alkylaryl polyester alcohol such as Triton-DF 12, a trademark product of Rohm & Haas, Philadelphia, PA.. Specific formulations are presented in Table I below:

TABLE I

| | Cleaner Formulations, wt. %* | | | | |
|---|---|---|---|---|---|
| Designation | $Na_2SiO_35H_2O$ | $Na_4P_2O_7$ | $Na_2CO_3$ | NaOH | EDTA (Di-sodium salt) |
| Reference | 50 | 50 | — | — | — |
| No. 8 | 50 | — | 40 | — | 10 |
| No. 10 | 50 | — | 20 | 30 | — |

*0.5 g/l wetting agent added

One formulation containing equal parts by weight of Na metasilicate and Na pyrophosphate was designated as the reference solution since this specific formulation represents the cleaner most commonly used on surface treatment lines in military ammunition plants.

A stock solution of each formulation was prepared to which 400 ppm $Ca^{++}$ and $Mg^{++}$ in a 3:2 molar ratio were added as the sulfate. This stock solution is referred to hereinafter as "hardness added" or "hard water". The hardness of the tap water used was 40 ppm $Ca^{++}$, $Mg^{++}$.

Both surfaces of mild steel panels (10.2 cm × 15.3 cm) were covered with thin films of typical "soils" by dipping or rubbing. The soils are listed in Table II below:

TABLE II

Effectiveness of Reference Cleaner with Various Soils
Cleaning Time 30 Second Intervals Required to Produce Water-break-free Surfaces

| Soil | Reference Cleaner in Tap Water* | Reference Cleaner in Hard Water* |
|---|---|---|
| Motor Oil (SAE 30) | 30 sec. wash | 30 sec. wash |
| Lard Oil | 60 | 60 |
| Dry Lubricant ($MoS_2$) | 30 | 60 |

*10 g/l of reference cleaner in either tap water (40 ppm $Ca^{++}$, $Mg^{++}$) or hard water (400 ppm $Ca^{++}$ and $Mg^{++}$ in 3:2 molar ratio)

Based on the data presented above, 45 mg of molybdenum disulfide were mixed with a drop of lard oil such that the diameter of the mixed drop was approximately 1.9 cm in diameter when applied to a surface of the mild steel panel. The drop was then spread uniformly over the panel surface with a tissue.

A reservoir of sufficient quantity of each cleaner formulation was used in the spraying chamber aforedescribed. A full spray, heated to 55°–65° C, was delivered at a nozzle pressure of 18 psi. The cleaning effectiveness of the formulations tested was determined as follows: The cleaner solution in the reservoir was heated to 60° C ± 5° with an immersion heater before spraying onto three panels held on a vertical rack, each panel being identically soiled. The panels were passed thru the spray at a speed of 4 cm/sec. After 30 seconds had elapsed, the rack was removed, the panels rinsed in a tank of cold flowing tap water, immersed for 5 seconds in 2% tartaric acid and rinsed again as before and drained for 30 seconds. The panels were then examined. This sequence of steps was repeated using the 30 second wash interval until waterbreak-free surfaces resulted. Three sets of specimens or panels for each formulation were tested, or a total number of nine per formulation. A rating system of 0 thru 9 was used to rank the cleaners, the numbers representing the total number of panels cleaned at the end of the wash interval stated. Results in hard water are presented after the slash in Table III below:

TABLE III

| Formulation Designation | Cleaning Data: Total Number of Panels Cleaned (Tap/Hard Water) within: 30 sec. | 60 sec. | 90 sec. | pH | Free Alkalinity* |
|---|---|---|---|---|---|
| Reference | 2/0 | 8/9 | 9/— | 12.1 | 1.6 |
| No. 8 | 9/9 | — | — | 12.1 | 2.5 |
| No. 10 | 9/6 | —/9 | — | 12.7 | 4.0 |

*Free Alkalinity: 25 ml of each formulation was titrated with standard 0.1N HCl to the phenolphthalein endpoint. Results are expressed as g/l $Na_2O$.

Potential cleaning ability of formulations may be assessed from the free alkalinity values which represent the potential for neutralization of fatty acids and suggests a direct measure of the relative life of the cleaners.

Each of the three formulations including the reference formulation completely emulsified lard oil in the saponification test which comprises adding 50 ml of the oil to 200 ml of the formulation in a stoppered cylinder, mixing, and heating to 60° C. The cylinder is then shaken vigorously and placed in a water bath at 40° C for 18 hours. The volume of oil floating and the saponified layer is recorded.

It is apparent from the foregoing that we have provided spray cleaner formulations which are devoid of any phosphates and yet compromise no cleaning ability when used in the surface treatment of metals. The resultant phosphate-free cleaners may be introduced into waterways without the attendant fear of promoting algae growth therein or eutrophication thereof.

We claim:

1. A metal cleaner composition essentially free from phosphates, consisting essentially of
   about 50% by weight sodium metasilicate,
   about 40% by weight sodium carbonate, and
   about 10% by weight ethylenediamine tetraacetic acid disodium salt.

2. A metal cleaner composition essentially free from phosphates, consisting essentially of about 10 parts of the composition of claim 1 and about 0.5 parts of a wetting agent in 1000 parts of water.

3. The composition of claim 2, wherein the wetting agent is a polyethoxylated straight chain alcohol.

4. A metal cleaner composition essentially free from phosphates, consisting essentially of
   about 50% by weight sodium metasilicate,
   about 20% by weight sodium carbonate, and
   about 30% by weight sodium hydroxide.

5. A metal cleaner composition essentially free from phosphates, consisting essentially of about 10 parts of the composition of claim 4 and about 0.5 parts of a wetting agent in 1000 parts of water.

6. The composition of claim 5, wherein the wetting agent is a polyethoxylated straight chain alcohol.

* * * * *